US011387595B2

(12) United States Patent
Schnoell et al.

(10) Patent No.: US 11,387,595 B2
(45) Date of Patent: Jul. 12, 2022

(54) CONNECTOR ARRANGEMENT WITH ENVIRONMENTAL AND ELECTRICAL PROTECTION

(71) Applicant: MAGNA INTERNATIONAL INC., Aurora (CA)

(72) Inventors: Gregor Schnoell, Ernsthofen (AT); Martin Winter, Dietach (AT)

(73) Assignee: MAGNA INTERNATIONAL INC., Aurora (CA)

( * ) Notice: Subject to any disclaimer, the term of this patent is extended or adjusted under 35 U.S.C. 154(b) by 0 days.

(21) Appl. No.: 17/274,204

(22) PCT Filed: Sep. 11, 2019

(86) PCT No.: PCT/CA2019/051281

§ 371 (c)(1),
(2) Date: Mar. 8, 2021

(87) PCT Pub. No.: WO2020/051698

PCT Pub. Date: Mar. 19, 2020

(65) Prior Publication Data

US 2021/0336378 A1 Oct. 28, 2021

Related U.S. Application Data

(60) Provisional application No. 62/729,665, filed on Sep. 11, 2018.

(51) Int. Cl.
*H01R 13/52* (2006.01)

(52) U.S. Cl.
CPC ..... *H01R 13/5213* (2013.01); *H01R 13/5202* (2013.01)

(58) Field of Classification Search
CPC ..... H01R 13/4538; H01R 13/5213; H01R 13/5202
See application file for complete search history.

(56) References Cited

U.S. PATENT DOCUMENTS

| | | | | |
|---|---|---|---|---|
| 4,176,897 | A | 12/1979 | Cameron | |
| 5,338,211 | A | 8/1994 | Kodama et al. | |
| 5,637,977 | A | 6/1997 | Saito et al. | |
| 5,716,224 | A | 2/1998 | Masuda et al. | |
| 7,794,252 | B2 * | 9/2010 | Sauer | H01R 13/527 439/186 |

(Continued)

*Primary Examiner* — Tho D Ta
(74) *Attorney, Agent, or Firm* — Dickinson Wright PLLC

(57) ABSTRACT

A system for making an autonomous connection between a first electrical contact and a second electrical contact includes a first receiver with the first contact therein and a second receiver with a second contact therein. The receivers are at least partially disposed within respective first and second housings. A first cover is disposed over an opening of the first housing and a second cover is disposed over an opening of the second housing. The covers seal the ends of the housings and the ends of the receivers, providing a double seal to the contacts. As the receivers are moved toward each other, the covers are automatically moved out of engagement with the receivers and housing. As the receivers are moved away from each other, the covers are automatically moved back into engagement with the housings and receivers.

19 Claims, 8 Drawing Sheets

(56) References Cited

U.S. PATENT DOCUMENTS

| | | | | |
|---|---|---|---|---|
| 8,376,760 | B1 * | 2/2013 | Kostrzewski ..... | H01R 13/4538<br>439/138 |
| 9,431,778 | B1 * | 8/2016 | Mueller ..... | F16L 55/24 |
| 9,543,719 | B2 | 1/2017 | Bartholomew et al. | |
| 9,653,838 | B2 | 5/2017 | Lewis et al. | |
| 10,734,769 | B2 * | 8/2020 | Kralik ..... | H01R 13/631 |
| 2010/0022110 | A1 | 1/2010 | Dufresne De Virel | |

* cited by examiner

FIG. 3
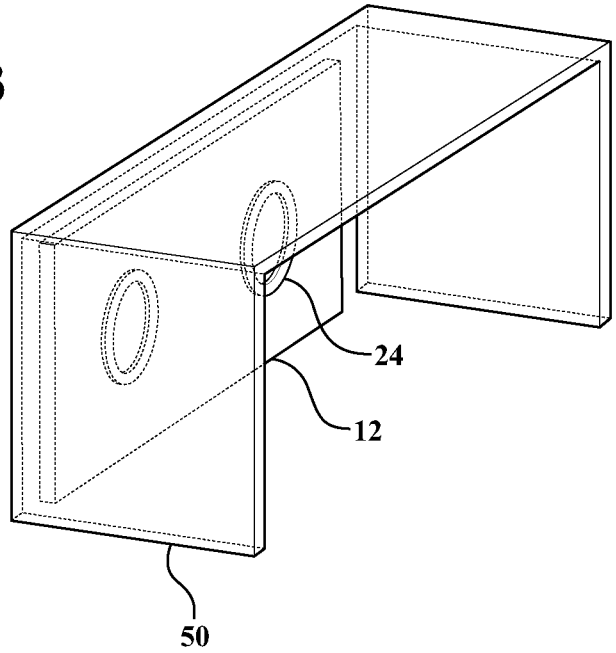
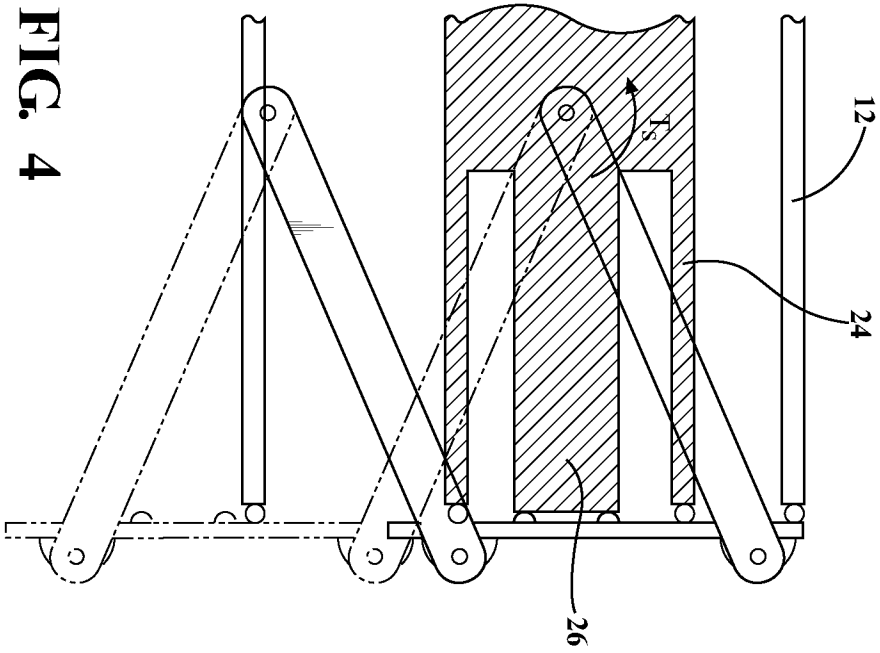
FIG. 4

FIG. 7A
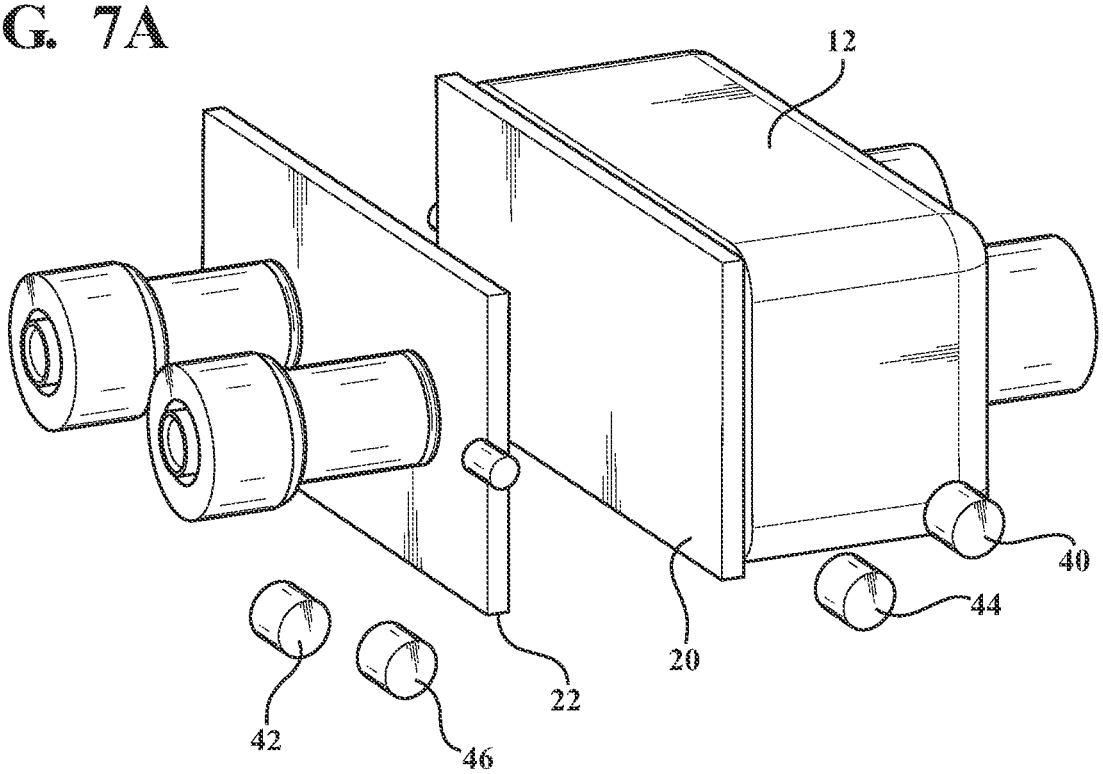
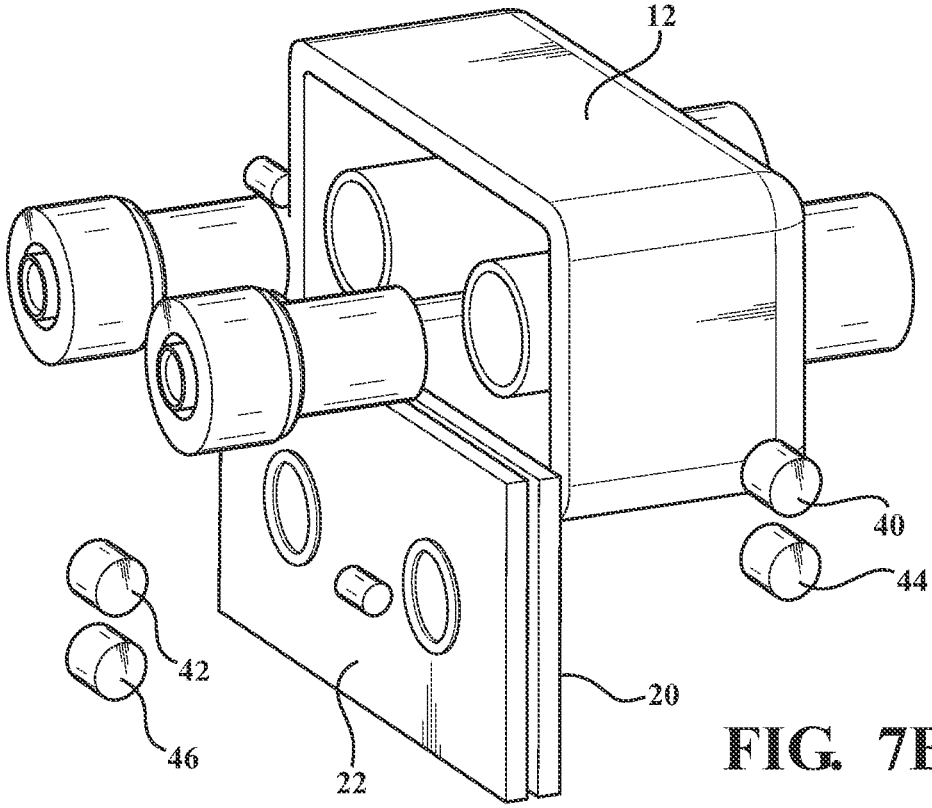
FIG. 7B

FIG. 8B
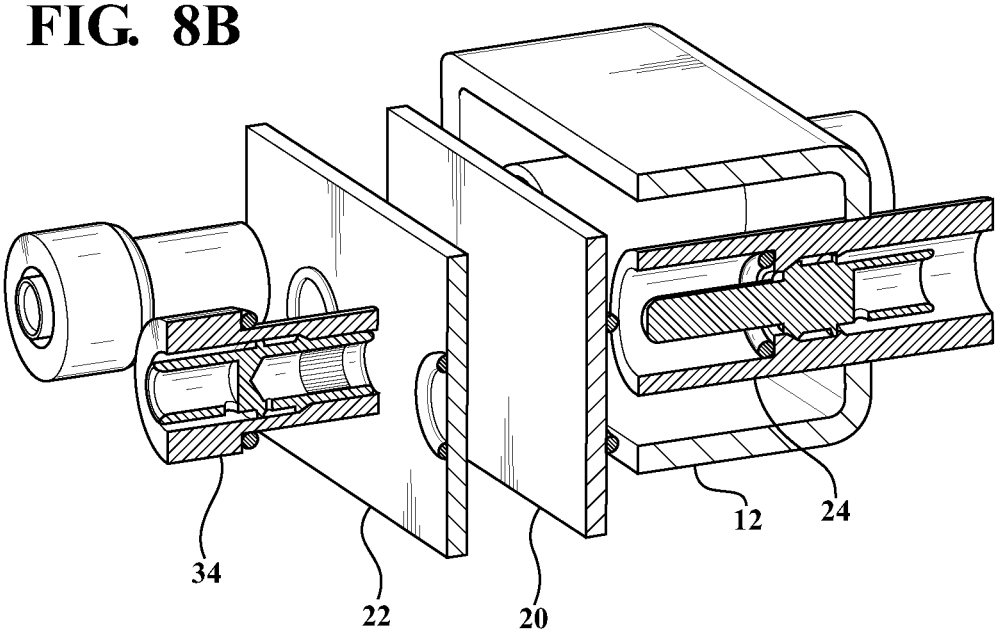
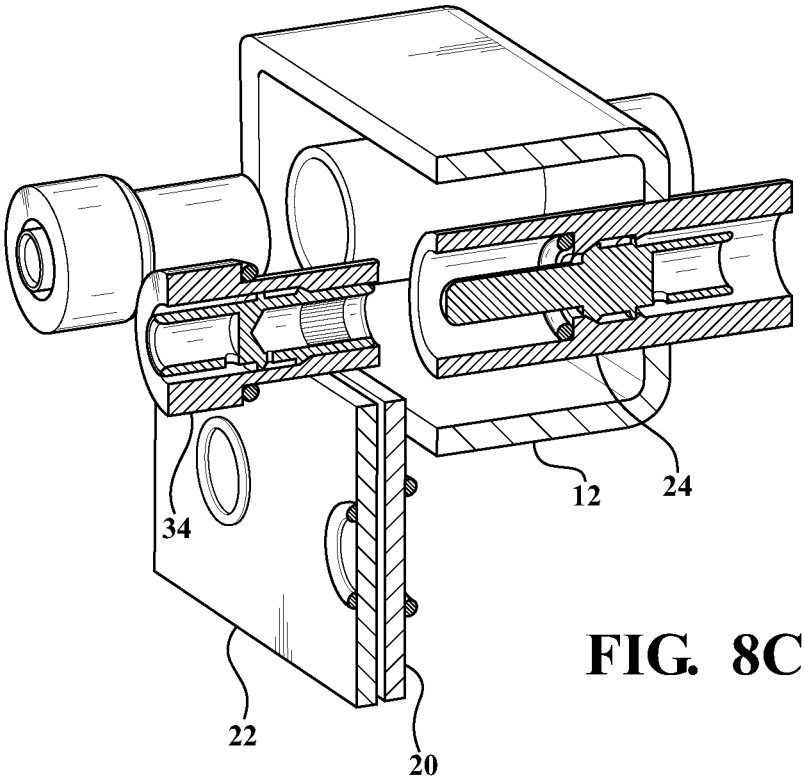
FIG. 8C

FIG. 8D
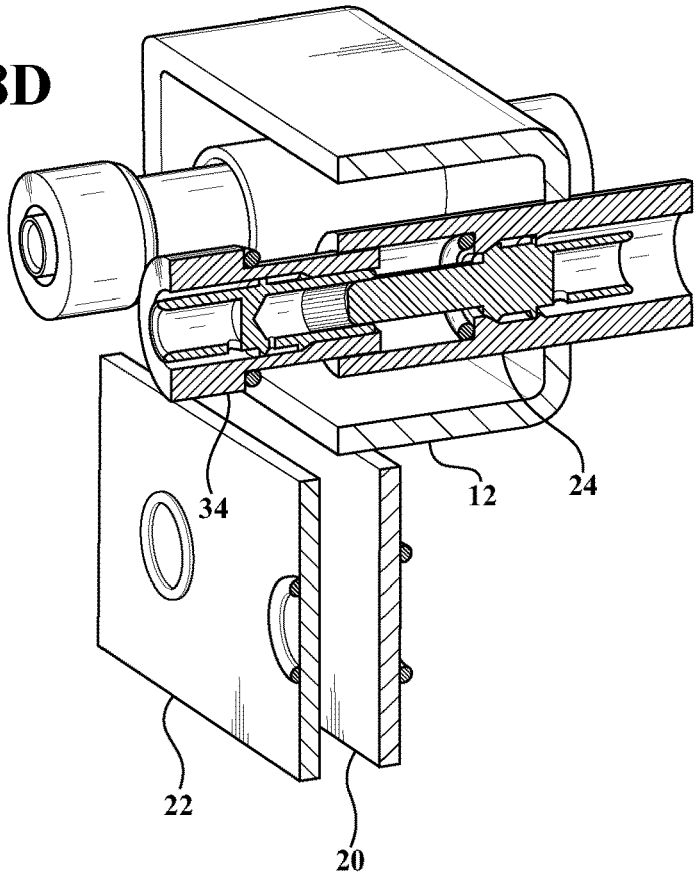
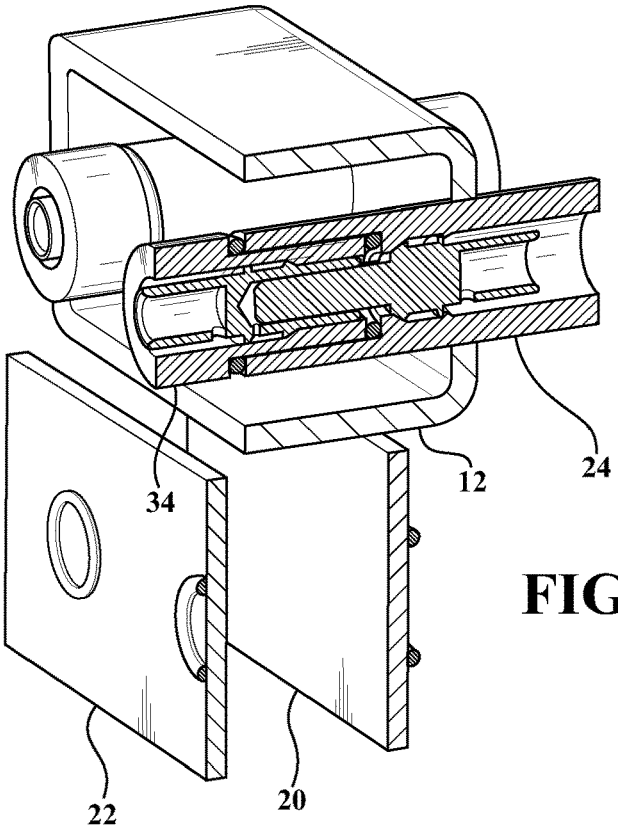
FIG. 8E

CONNECTOR ARRANGEMENT WITH ENVIRONMENTAL AND ELECTRICAL PROTECTION

CROSS-REFERENCE TO RELATED APPLICATION

This U.S. National Stage Patent Application claims the benefit of PCT International Patent Application Serial No. PCT/CA2019/051281 filed Sep. 11, 2019 entitled "Connector Arrangement With Environmental And Electrical Protection" which claims the benefit of and priority to U.S. Provisional Patent Application Ser. No. 62/729,665 filed on Sep. 11, 2018, titled "Connector Arrangement With Environmental Protection," the entire disclosures of which are hereby incorporated by reference.

TECHNICAL FIELD

The present disclosure relates to a connector system for high current and signal connections. More particularly, the present disclosure relates to a connector system with environmental protection to shield the connectors from harsh environmental conditions.

BACKGROUND OF THE DISCLOSURE

Passenger vehicles include a variety of electrical connections for communicating and transferring power throughout the vehicle. In many cases, the connections must be connected and disconnected at different times. Due to space constraints within the vehicle, the connections are often not easily accessible and manually completing the connection can be difficult.

In some cases, the connectors that form the connection can be exposed to harsh environmental conditions, such as water, ice, or snow. Due to the nature of these connections, it is desirable to protect the connectors from exposure to these environmental conditions, because exposure to water can damage the connectors and the resulting connection when the connectors are coupled.

To protect the connectors from environmental exposure, the connectors may include a cover or casing that shields the connector. These covers can block water from reaching the connector, but they must be removed prior to making a connection. This can be difficult when access to the connectors is limited. Moreover, the connection may need to be disconnected and reconnected at a later time, so the cover may need to be retained to the connector. Retaining the cover to the connector may result in additional space being occupied by the covers in their open configuration, requiring space to be reserved in the vehicle for the covers in this state. Additionally, when the cover is removed, and before the connection is made, the connectors will be exposed to the environmental conditions that the covers previously blocked.

Connectors of various types may also be susceptible to inadvertent electrical contact between them. In the absence of covers, connectors may make contact and create an electrical path at an undesirable time, or may result in an electrical short if an incorrect contact type is made.

In view of the foregoing, there remains a need for improvements to connectors and associated covers.

SUMMARY OF THE INVENTION

A system for connecting a first contact with a second contact, the system comprising: a first contact in the form of a plug fixed within a cavity of a first receiver; a second contact in the form of a socket fixed within a cavity of a second receiver, wherein the socket is sized and arranged to receive the plug in a mating connection, and one of the first receiver and the second receiver is sized and arranged to receive the other of the first receiver and the second receiver; a first cover having a closed position and an open position, wherein the first cover seals an interior of the first receiver in the closed position; a second cover having a closed position and an open position, wherein the second cover seals an interior of the second receiver in the closed position; wherein relative movement of the first receiver toward the second receiver automatically moves the first and second covers from the closed positions to the open positions via a kinematic linkage that begins at a pre-defined distance between the first and second receiver.

In one aspect, the system includes a first housing and a second housing, wherein the first receiver is disposed at least partially within the first housing and the second receiver is disposed at least partially within the second housing.

In one aspect, the first cover seals an opening of the first housing when in the closed position and the second cover seals an opening of the second housing when in the closed position.

In one aspect, the first housing and the first receiver each define an outer edge that are generally co-planar, and the second housing and the second receiver each define an outer edge that are generally co-planar, wherein the first cover seals against the outer edges of the first receiver and the first housing when the first cover is in the closed position and the second cover seals against the outer edges of the second receiver and the second housing when the second cover is in the closed position.

In one aspect, the first contact is received in the second contact in a connected state, the first and second covers are in the open position in the connected state, and when the first and second covers are in the closed position, the first and second contacts are in a disconnected state.

In one aspect, the first receiver and the second receiver have a cylindrical shape, the first receiver defines an annular space between the first contact the first receiver, and the second receiver is received in the annular space when the first and second contacts are in the connected state.

In one aspect, the first and second covers are biased toward the closed position, wherein movement of the first and second receivers away from each other automatically moves the first and second covers toward the closed position.

In one aspect, the system includes a first sealing member disposed between the first cover and first receiver when the first cover is in the closed position and a second sealing member disposed between the second cover and the second receiver when the second cover is in the closed position.

In one aspect, the first cover and the second cover each include a sealing material disposed on an inner surface of the first and second covers, wherein the sealing material on each of the first and second cover contacts the outer edges of the first receiver, first housing, second receiver, and second housing, respectively, when the first and second covers are in the closed position.

In one aspect, the second receiver includes a head portion at an inner end thereof and having an enlarged diameter relative to an outer end of the second receiver, and wherein an outer end of the first connector seals against the head portion when the first and second receivers are connected and the first and second contacts are connected within the first and second receivers.

In one aspect, the first connector includes an inner ledge portion, and the outer end of the second receiver seals against the inner ledge portion when the first and second receivers are connected.

In one aspect, the system includes a U-shaped cover disposed over the first and second housings and configured to shield the first and second receivers when the first and second covers are moved away from the closed position and the second receiver is not received in the first receiver.

According to another aspect of the disclosure, a method for connecting a first contact with a second contact includes translating a first contact in the form of a plug and a second contact in the form of a socket from a disconnected position relatively axially toward each other into a connected position, wherein the plug is fixed within a first receiver and the socket is fixed within a second receiver; in response to translating the plug and socket relatively toward each other, moving a first cover away from a sealed closed position on the first receiver toward an open position and a moving a second cover away from a sealed closed position on the second receiver toward an open position; wherein the first cover and the second cover are kinematically linked in response to moving the first and second receivers toward each other at a predefined distance between the first and second receivers, such that relative movement between the first and second receivers causes the automatic translation of the first and second covers.

In one aspect, the first receiver is fixed to a first housing, and the second receiver is fixed to a second housing, and the first and second covers seal the first and second housings, respectively, when the first and second covers are in the closed position.

In one aspect, the first receiver and the first contact define an annular space therebetween, and the second receiver is received in the first housing when the first and second covers are open, wherein an outer end of the first receiver seals against an inner portion of the second receiver when the second receiver is received in the annular space.

BRIEF DESCRIPTION OF THE DRAWINGS

Other advantages of the present invention will be readily appreciated, as the same becomes better understood by reference to the following detailed description when considered in connection with the accompanying drawings wherein:

FIG. 3 is a schematic view illustrating U-shaped protection;

FIG. 4 is a schematic view illustrating base kinematics for one of the covers;

FIGS. 7A, 7B and 7C are perspective views illustrating the transition of the first and second covers from a closed position to an open position as the first and second connectors are moved from a disconnected state into a connected state;

FIGS. 8A, 8B, 8C, 8D and 8E are perspective cross-sectional views illustrating the second contacts being received in the first contacts during the transition from a disconnected to a connected state.

DESCRIPTION OF THE ENABLING EMBODIMENT

Figure 1:
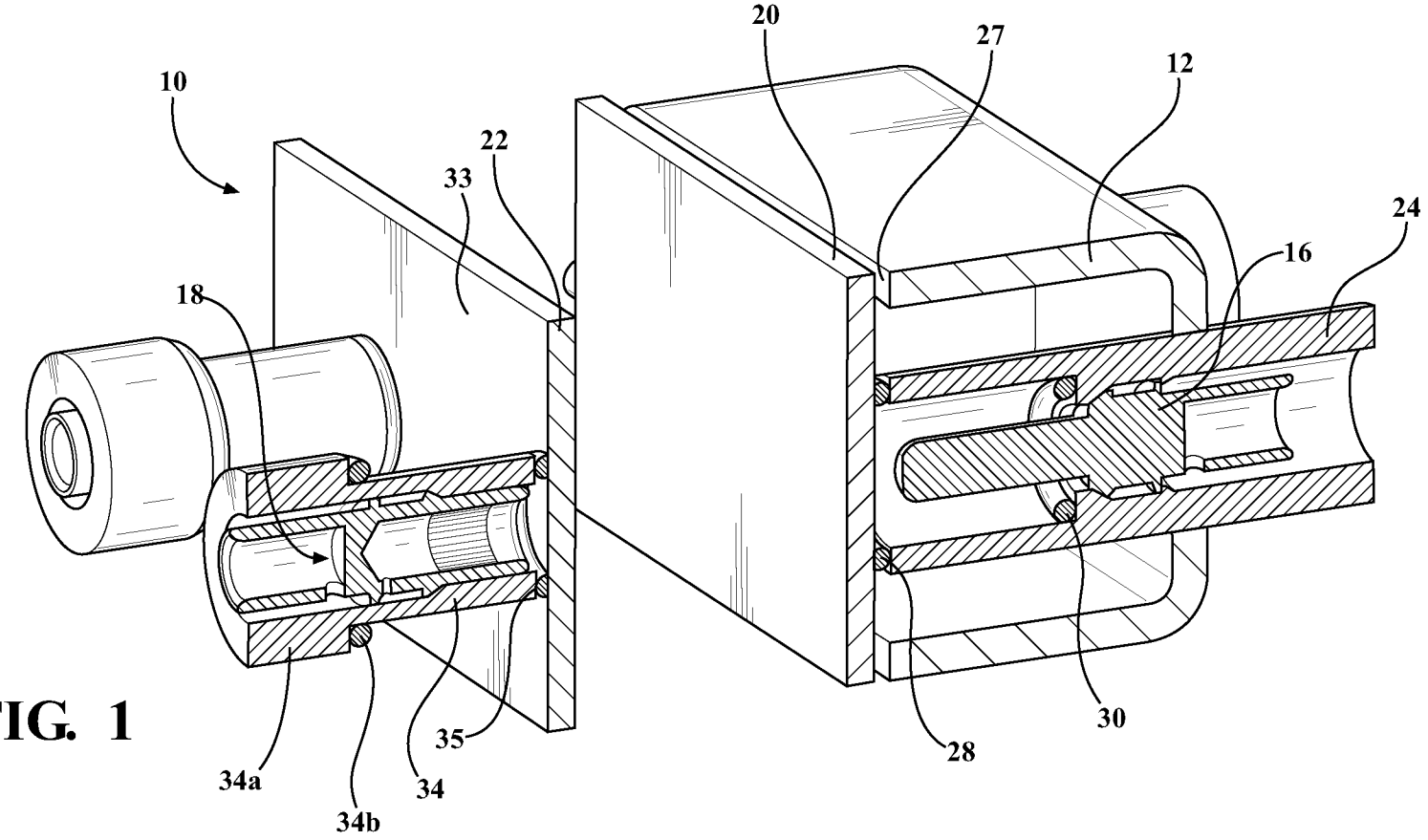
FIG. 1 is a perspective view of a connector system, illustrating a first contact and a second contact in cross-section and having covers engaged when the system is in a disconnected state.

Referring to the Figures, wherein like numerals indicate corresponding parts throughout the several views, a system 10 for making an autonomous connection with environmental protection and electrical protection against contact is provided. As best shown in FIGS. 1-8, the system 10 includes a first housing 12 and a second housing (not shown), one or more first contacts 16, and one or more second contacts 18, where, in a connected state, the second contacts 18 are received within the first contacts 16, and the second housing is received within the first housing 12. The system 10 further includes a first cover 20 and a second cover 22. The first cover 20 closes off and protects the first contact 16 within the first housing 12 when the system is in a disconnected state. The second cover 22 closes off and protects the second contact 18 within the second housing in the disconnected state. The covers 20 and 22 further protect the contacts 16, 18 from electrical contact. The covers therefore provide dual protection against both the environment and electrical protection against contact. For purposes of discussion, protection against the environment will be primarily discussed, but it will be appreciated that such protections provide similar benefits of electrical protection against contact.

Throughout the Figures, the system 10 is illustrated in the disconnected state or the connected state, or a transitional state therebetween. As the first contact 16 is brought together with the second contact 18, the covers 20, 22 are automatically moved from a closed position to an open position, thereby permitting the second housing and the second contact 18 to be received within the first housing 12 and the first contact 16, respectively. Similarly, when the first and second contacts 16, 18 are disconnected and moved away from each other, the covers 20 and 22 are automatically moved from the open position back to the closed position, thereby closing off the respective housings and contacts therein.

With reference to FIG. 1, the first housing 12 is shown in cross-section, along with the first contact 16. A first receiver 24 is disposed at least partially within the first housing 12, such that the first receiver extends approximately to an opening defined by the housing 12. The first receiver 24 may have a generally hollow cylindrical shape and defining a cylindrical cavity therethrough. The first contact 16 is disposed within the cavity defined by the first receiver 24 and supported within the first receiver 24 by internal structure. As shown, the first contact 16 is held in place within the receiver 24 by a press-fit or snap-fit connection and includes a semi-conical mating surface that corresponds to a mating surface of the internal structure of the receiver 24.

The first contact 16 can also be described as a male contact having a generally solid cylindrical protrusion 26 extending coaxially with the receiver 24. The receiver 24 and protrusion 26 combine to define an annular space surrounding the protrusion 26 and within the receiver 24. This annular space is configured to receive a female end of the second contact 18 when the system 10 is in the connected state.

The housing 12 and the receiver 24 each define an outer edge or surface that may be generally co-planar. The housing 12 may include a housing sealing member or housing seal 27 disposed at the outer edge thereof. The sealing member 27 may have a shape that corresponds to the shape of the outer edge of the housing 12, such that when cover 20 is disposed against the first housing 12, the interior of the housing 12 will be sealed by the cover 20. The sealing member 27 is made from a flexible and resilient material in a manner known in the art, such as rubber or foam. The sealing member 27 may be disposed on the edge of the housing 12, or it may be disposed on the cover 20, such that it moves along with the cover 20 into and out of engagement with the housing 12.

The receiver 24 may also include a receiver sealing member or receiver seal 28. Similar to the housing seal, the receiver seal 28 may be disposed on the receiver or it may be disposed on the cover 20. The receiver seal 28 may have an annular shape to correspond to the shape of the outer edge of the receiver 24. In the case of the receiver seal 28 being on the cover 20, the receiver seal 28 may have a shape larger that the edge of the receiver 24. The receiver seal 28 may be made of the same material as the housing seal, or it may be made of another sealing material.

With the cover 20 in the closed position against the housing 12 and receiver 24, the housing seal and the receiver seal 28 will be compressed between the cover 20 and the housing 12 or receiver 24, respectively. In one approach, the cover 20 may include an inner surface that is generally completely covered by sealing material, such that the sealing material functions as a seal for both the housing 12 and the receiver 24. In another approach, the housing seal and the receiver seal 28 may be disposed on both the cover 20 and the housing 12 and receiver 24. It will be appreciated that other combinations of seals on the cover 20, housing 12, and receiver 24 may be used.

Optionally, the receiver 24 may include an inner seal 30 disposed within the receiver 24 adjacent the base of the protrusion 26 of the first contact 16. This inner seal 30 will contact an outer end of the second contact 18 when the second contact 18 is received on the first contact 16 and within the first receiver 24.

The first contact 16 includes an inner end that is generally hollow and configured to receive a wire end, which may be crimped to the first contact 16.

The first housing 12 and the first receiver 24 combine to define an open cavity for receiving the second housing when the first and second housings are connected. Thus, the second contact 18 is received over the first contact 16 and within the first receiver 24, and the second housing is received over the first receiver 24 and within the first housing 12.

With respect to the second housing, the second housing has features similar to those described above regarding the first housing. Unless otherwise noted, the above descriptions of the first housing 12 also apply to the second housing.

The second housing differs from the first housing 12 in that the size of the second housing is smaller than the first housing 12, such that the second housing may be received within the first housing 12 when connected. Similar to the first housing 12, the second housing may include a housing seal 33 disposed between an outer edge of the second housing and the second cover 22. The housing seal may be disposed on the edge of the second housing, on the second cover 22, or both.

The second housing includes a second receiver 34 at least partially disposed within the interior of the second housing. The second receiver 34 extends approximately to the same axial position as the second housing, such that the outer edges of the second receiver 24 and the second housing are generally coplanar. The second receiver 34 has a generally hollow cylindrical shape with a cavity extending therethrough, and includes internal structure for holding the second contact 18 in place within the second receiver 34.

Similar to the first receiver 24, the second receiver 34 may include a second receiver seal 35 disposed on an outer edge of the second receiver. The seal 35 may be disposed on the edge of the second receiver 34, on the second cover 22, or both. The second receiver seal 35 may have an annular shape to correspond to the shape of the outer edge of the receiver 34. In the case of the receiver seal 35 being on the cover 22, the receiver seal 35 may have a shape larger that the edge of the receiver 34. The second receiver seal 35 may be made of the same material as the housing seal, or it may be made of another sealing material.

The second receiver 34 may include an enlarged diameter head portion 34*a* disposed an inner end of the second receiver 34. The head portion 34*a* may have a diameter that generally corresponds to the diameter of the first receiver 24. The diameter of the inner end of the second receiver 34 is smaller than the diameter of the first receiver 24, such that the second receiver 34 can be received inside the first receiver 24 when mated. When mated, the head portion 34*a* will come into contact with the outer end of the first receiver 24.

In one approach, the head portion 34*a* of the second receiver 34 includes a head portion seal 34*b*. The head portion seal 34*b* may have a generally annular shape and be disposed on the face of the head portion 34*a* that surrounds the smaller diameter of the second receiver 34. When the second receiver 34 mates with the first receiver 24, the head portion seal 34*b* will be pressed between the head portion 34*a* and the outer edge of the first receiver 24, thereby sealing the first receiver 24 and the second receiver 34, and the contacts 16, 18 disposed therein.

The second contact 18 is disposed within the cavity of the second receiver 34 and held in place in a manner similar to that described above with respect to the first contact 16 and first receiver 24. Unlike the first contact 16 and receiver 24, the second contact 18 and the second receiver 34 do not define a substantial annual space between them. However, because the second contact 18 is disposed within the second receiver 34, there may be a nominal annular space between them. The lack of a substantial annular space is due to second receiver 34 being sized and configured to be received in the first receiver 24, with the second contact 18 sized and configured to receive the first contact 16. Thus, the second receiver 34 may be described as a "male" component and the first receiver 24 may be described as a "female" component, with the opposite being true for the first and second contacts 16, 18. The first contact 16 is the "male" component and the second contact 18 is the "female" component.

Accordingly, the second contact 18 has a generally hollow cylindrical shape at its outer end, with an outer cavity sized and configured to receive the first contact 16. Thus, when connected, the first contact 16 is received within the outer cavity of the second contact 18. The second contact may also define an inner cavity at the inner end, with the inner cavity configured to receive a wire end that may be crimped to the inner end of the second contact 18.

In the above description, a single first contact 16 and a single second contact 18 have been described in relation to the first housing 12 and second housing, respectively. However, each of the first housing 12 and the second housing may include multiple first contacts 16 and second contacts 18, respectively. In the case of multiple contacts within each housing, the contacts may be connected to each other via webbing or other structure to maintain the spacing and positioning of the contacts relative to each other. For the purposes of further discussion, a single first contact 16 and second contact 18 will be described. Unless other noted, the functionality of the single contacts applies equally to a system where multiple contacts are disposed within a single housing.

The first and second housings may be made of an injection molded plastic material. Similarly, the first and second receivers 24 and 34 may be made from an injection molded plastic. The housings and receivers may be formed as a single integral and homogenous structure, such as via injection molding or pressure casting. In another approach, the housings may be made of a metal material. In this approach, the receivers are preferably made of a plastic material to include the contacts disposed therein from the metal housing. In one example, the housings may include metal plating for shielding purposes when the housings are made of plastic.

Figure 2:
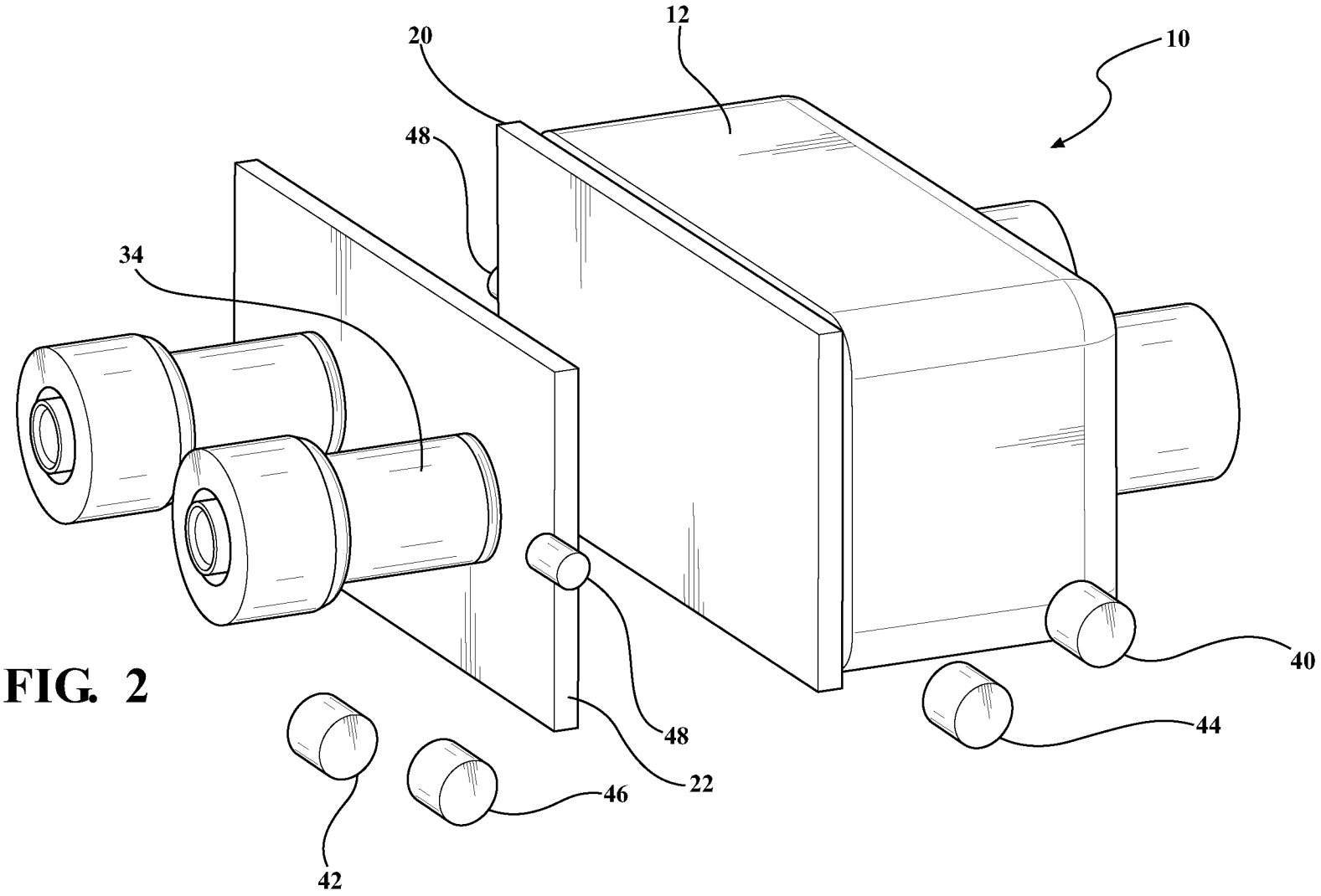
FIG. 2 is a perspective view illustrating multiple first contact receivers having a common cover and multiple second contact receivers having a common cover, and an array of poles for supporting a four-point bearing.

FIGS. 1 and 2 illustrate the covers 20 and 22 in a closed position when the housings are in a disconnected or unplugged state. When the housings are brought together, thereby bringing together the first contact 16 and the second contact 18, the covers 20 and 22 will move out of engagement with the housings and the receivers. When the covers 20 and 22 move out of engagement with the housings and receivers, the seals formed between them will open. When the covers are in an open position, the first contact 16 can be received within the second contact, the second receiver can be received in the first receiver, and the second housing can be received in the first housing.

With reference to FIG. 2, the covers are automatically opened via the use of a linkage system having a base kinematic. The covers 20 and 22 will move along a defined path to a defined locked position based on the kinematic linkage. In one aspect, the kinematic linkage is not permanent. Rather, when the receivers 24 and 34 are moved together, the linkage will start at a predefined distance between the receivers 24, 34.

The defined path is dependent on the features of the linkage, which can be varied to provide the desired path. In one approach, a first fixed pin 40 is fixed to an exterior of the first housing 12 and protrudes in direction perpendicular to the path of translation of the housings. A second fixed pin 42 similarly protrudes from the second housing. The pins 40 and 42 are described as fixed with reference to their respective housings. During movement of the housings toward each other, the pins 40 and 42 will move with the housing.

A second pair of pins are moveable relative to the fixed pins 40, 42 and the housings. A first moveable pin 44 moves along a first curved path and orbits around the first fixed pin 40 during movement. A second moveable pin 46 moves along a second curved path that may be a mirror image of the first curved path, with the second moveable pin 46 orbiting around the second fixed pin 42. Thus, the first fixed pin 40 and the first moveable pin 44 define a first pin set, and the second fixed pin 42 and the second moveable pin 46 define a second pin set.

A central common pin 48 is disposed between the first pin set and the second pin set. When the housings are moved toward each other, the kinematic connection between the pins causes the common pin 48 to move downward, and the connection moves the moveable pins 44, 46 downward along their curved paths. At the beginning on the movement of the housings toward each other, the covers 20 and 22 will move toward each other as they move downward along their curved path. As the covers approach each other, they will then move away from each other as they continue moving downward along the curved path. FIG. 2 illustrates the pins in their relative positions in the disconnected state. The movement of the pins is illustrated in FIGS. 4 and 6-8.

With reference to FIG. 3, the system 10 may include a U-shaped protection member or cover 50. The cover 50 is disposed above the housings to add additional environmental protection during the brief period of time when the covers 20, 22 are disengaged from their respective housings but the connection has not yet been made. Thus, in the event of rain or the like, the cover 50 will help block the rain from reaching the contacts 16, 18 prior to the housings mating. For example, FIGS. 7B, 8B, and 8C illustrate a condition where the covers 20 and 22 are disengaged, but the connection is yet to be established.

When the first housing 12 and the second housing are moved toward each other, the covers 20, 22 will move away from their engagement with the receivers 24 and 34, as well as the first housing 12 and the second housing. When the covers 20, 22 are initially moved away from their sealing engagement, the contacts 16, 18 and other structure within the housings are briefly exposed to the elements. Thus, the cover 50 provides an additional protection against the elements during this time.

As the housings continue to move toward each other and initially into a receiving engagement with each other, the contacts 16, 18 will be additionally protected from the elements. Upon a full insertion of the second receiver 34 into the first receiver 24, the head portion seal 34*b* will press against the outer edge of the first receiver 24, thereby sealing off the cavities that house the first contact 16 and second contact 18. The cover 50 therefore can provide additional protection until the receivers 24 and 34 are sealed together.

Figure 5:
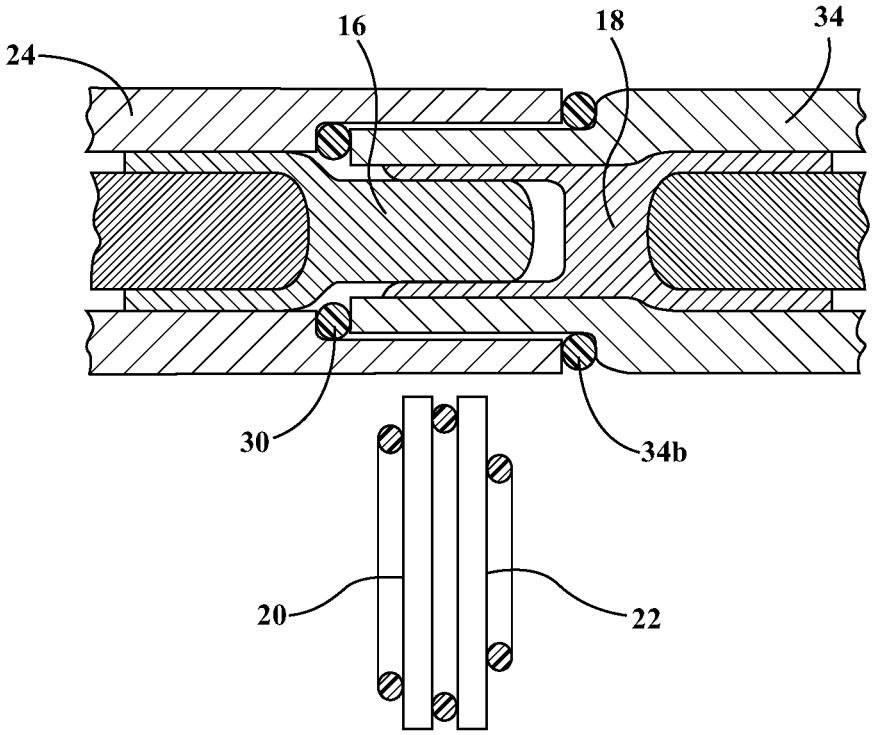
FIG. 5 is a schematic cross-sectional view illustrating the contacts as a connected pair, with the covers in an open position.
Figure 6:
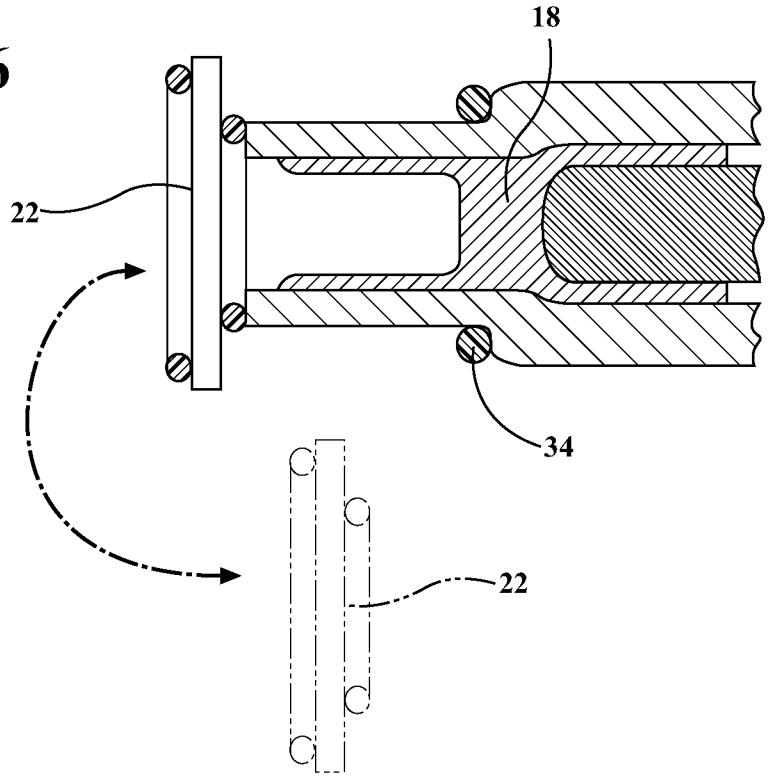
FIG. 6 is a schematic cross-sectional view of a first contact and receiver, with the first cover having a cover path defined by modified base kinematics.

FIG. 5 illustrates an example of a connected pair of receivers 24, 34 and contact 16, 18. FIG. 5 illustrates a rear view of the connected receivers 24, 34, from an opposite side of the previously described Figures. Thus, the second receiver 34 and second contact 18 are shown on the right side of FIG. 6, and the first receiver 24 and first contact 16 are shown on the left side. As shown in FIG. 6, the second receiver 34 is received in the cavity of the first receiver 24, and the head portion 34*a* is pressed against the end of the first receiver 24, with the seal 34*b* disposed axially therebetween. FIG. 5 also shows the optional seal 30 disposed between the end of the second receiver 34 and an inner annular ledge of the first receiver 24. The first contact 16, shown in the form of a plug or pin, is received within the opening of the second contact 18, shown in the form of a socket. The covers 20, 22 are shown in their open position below the connected pair of receivers 24, 34 and contacts 16, 18. The housings are omitted from this view.

FIG. 6 illustrates the second receiver 34 and contact 18, with the second cover 22 shown in both the closed and open position. The path of travel of the cover 22 is also illustrated.

In one form, the covers 20 and 22 are spring loaded or biased along with the kinematic linkage to bias the covers 20, 22 toward their closed positions. When the mating connection is disconnected, the bias in the kinematic linkage will help return the covers 20, 22 to their closed position.

Figure 7C:
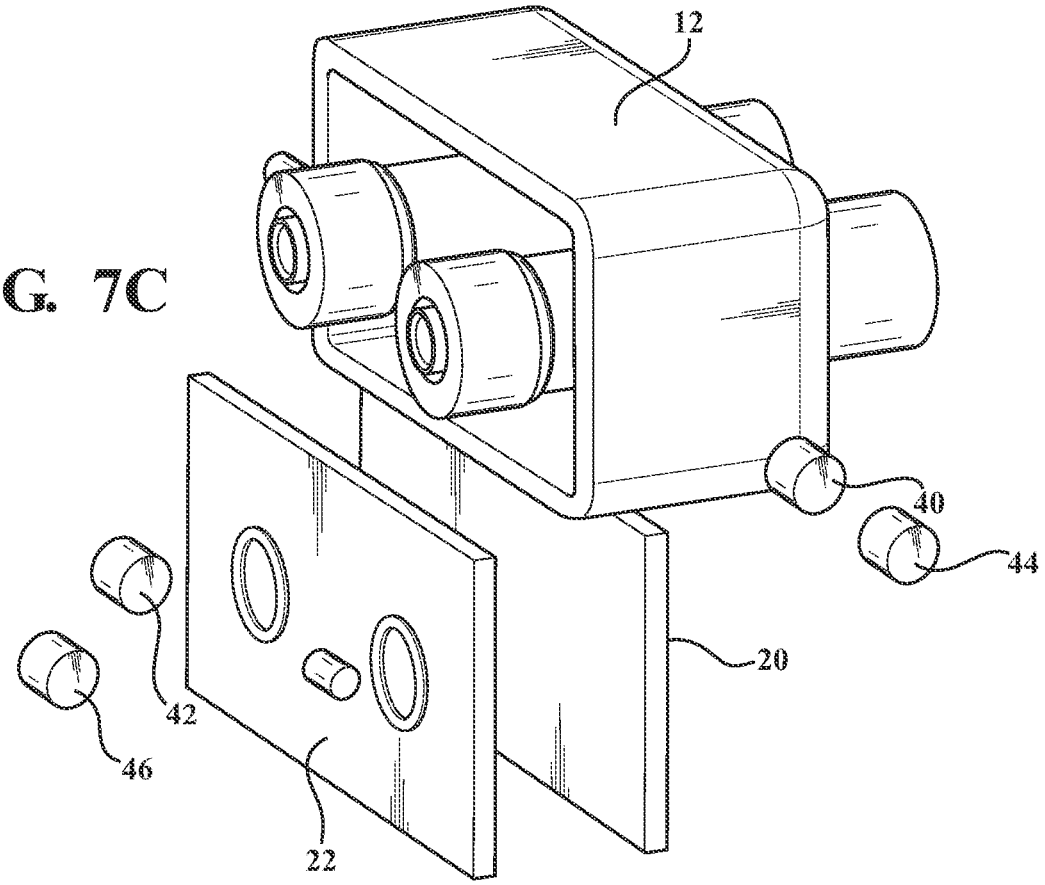

FIGS. 7A, 7B, 7C, 8A, 8B, 8C, 8D and 8E illustrate the process of connecting the first contact 16 to the second contact 18, showing the receivers 24 and 34 being brought together and the covers 20 and 22 moving from their closed position to their open position. FIG. 7A shows the covers in their fully closed position. FIG. 7B shows the covers in an intermediate position, with the second receivers 34 not yet engaged with the first receivers 24. In this position, the cover 50 may provide the additional protection from the elements described above. FIG. 7C illustrates the second receivers 34 fully inserted into the first receivers 24, with the covers 20, 22 in their fully open position.

Figure 8A:
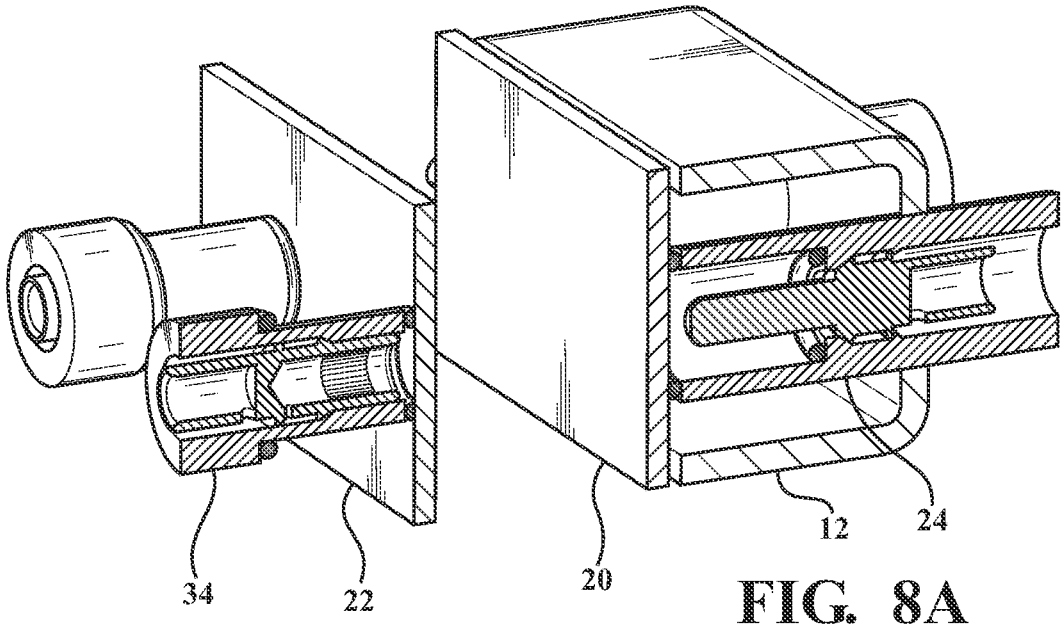

FIGS. 8A, 8B, 8C, 8D and 8E include additional views during the connection process. FIGS. 8A, 8B, 8C, 8D and 8E also illustrate the components in cross-section. FIGS. 8A, 8C, and 8E correspond to FIGS. 7A, 7B, and 7C, respectively. FIG. 7A illustrates the covers 20 and 22 in their closed positions, sealing both the receivers 24, 34 and the housings.

FIG. 7B illustrates a position shortly after the housings have begun moving toward each other. The covers 20 and 22 have moved away from their respective sealing seats, such that the receivers 24, and 34 and respective housings are no longer sealed. FIG. 7B illustrates the seal for the second receiver 34 being attached to the second cover 22, and the cover is shown having moved axially away and also downward relative to the second receiver 34. The first cover 20 is shown in a similar, mirrored position, with the first cover having moved axially away and downward from the first receiver 24. In this state, the covers 20 and 22 are axially closer to each other than in the closed position.

FIG. 8C illustrates another intermediate state, showing the covers 20 and 22 having moved axially closer to each other and further downward. In this position, the covers 20 and 22 are nearly touching each other. The first receiver 24 and second receiver 34 are not yet connected.

FIG. 8D shows yet another intermediate state. In this position, the second receiver 34 has been received partially within the first receiver 24, and the first contact 16 has been received partially within the second contact 18. The receivers 24, 34 and contacts 16, 18 are not yet fully connected or sealed. The covers 20 and 22 have moved axially away from each other relative to FIG. 8C and further downward. In this position, the covers 20 and 22 are below their respective housings.

FIG. 8E shows the fully connected state. The second receiver 34 has been fully received in the first receiver 24. The first contact 16 has been fully received in the second contact 18. The covers 20 and 22 have moved axially further away from each other relative to FIG. 8D, and have also moved lower.

The above described and illustrated movement of the covers 20 and 22 occurs automatically in response to the relative movement between the first set of components and the second set of components. Similarly, the covers will return to their closed positions automatically by moving the sets of components out of a connected engagement and back toward their initial disconnected positions. A spring bias may be used to assist in keeping the covers 20 and 22 in a closed position when the components are in a disconnected state.

The first and second sets of components have been described as moving toward each other. It will be appreciated that this movement is relative, and that one set of components may remain in a fixed position, with the other set of components being the set that moves. It will also be appreciated that above and below are relative and in reference to the illustrated Figures. The covers 20 and 22 could also move upward in the illustrated Figures by using a different kinematic linkage. Similarly, the illustrated movement could be accomplished at different orientations, such that downward in the Figures can be any other orientation.

Obviously, many modifications and variations of the present invention are possible in light of the above teachings and may be practiced otherwise than as specifically described while within the scope of the appended claims. These antecedent recitations should be interpreted to cover any combination in which the inventive novelty exercises its utility.

What is claimed is:

1. A system for connecting a first contact with a second contact, the system comprising:

a first housing;

a second housing;

a first contact in the form of a plug fixed within a cavity of a first receiver;

a second contact in the form of a socket fixed within a cavity of a second receiver, wherein the socket is sized and arranged to receive the plug in a mating connection, and one of the first receiver and the second receiver is sized and arranged to receive the other of the first receiver and the second receiver;

a first cover having a closed position and an open position, wherein the first cover seals an interior of the first receiver in the closed position; and a second cover having a closed position and an open position, wherein the second cover seals an interior of the second receiver in the closed position;

wherein the first receiver is disposed at least partially within the first housing and the second receiver is disposed at least partially within the second housing;

wherein the first housing and the first receiver each define an outer edge that are generally co-planar, and the second housing and the second receiver each define an outer edge that are generally co-planar, wherein the first cover seals against the outer edges of the first receiver and the first housing when the first cover is in the closed position and the second cover seals against the outer edges of the second receiver and the second housing when the second cover is in the closed position;

wherein relative movement of the first receiver toward the second receiver automatically moves the first and second covers from the closed positions to the open positions via a kinematic linkage that begins at a pre-defined distance between the first and second receiver.

2. The system of claim 1, wherein the first cover seals an opening of the first housing when in the closed position and the second cover seals an opening of the second housing when in the closed position.

3. The system of claim 1, wherein the first and second covers are biased toward the closed position, wherein movement of the first and second receivers away from each other automatically moves the first and second covers toward the closed position.

4. The system of claim 1 further comprising a first sealing member disposed between the first cover and first receiver when the first cover is in the closed position and a second sealing member disposed between the second cover and the second receiver when the second cover is in the closed position.

5. The system of claim 1, wherein the first cover and the second cover each include a sealing material disposed on an inner surface of the first and second covers, wherein the sealing material on each of the first and second cover contacts the outer edges of the first receiver, first housing, second receiver, and second housing, respectively, when the first and second covers are in the closed position.

6. The system of claim 1, wherein the first contact is received in the second contact in a connected state, the first and second covers are in the open position in the connected state, and when the first and second covers are in the closed position, the first and second contacts are in a disconnected state.

7. The system of claim 6, wherein the first receiver and the second receiver have a cylindrical shape, the first receiver defines an annular space between the first contact the first receiver, and the second receiver is received in the annular space when the first and second contacts are in the connected state.

8. The system of claim 1, wherein the second receiver includes a head portion at an inner end thereof and having an enlarged diameter relative to an outer end of the second receiver, and wherein an outer end of the first connector seals against the head portion when the first and second receivers are connected and the first and second contacts are connected within the first and second receivers.

9. The system of claim 8, wherein the first connector includes an inner ledge portion, and the outer end of the second receiver seals against the inner ledge portion when the first and second receivers are connected.

10. A system for connecting a first contact with a second contact, the system comprising:

a first contact in the form of a plug fixed within a cavity of a first receiver;

a second contact in the form of a socket fixed within a cavity of a second receiver, wherein the socket is sized and arranged to receive the plug in a mating connection, and one of the first receiver and the second receiver is sized and arranged to receive the other of the first receiver and the second receiver;

a first cover having a closed position and an open position, wherein the first cover seals an interior of the first receiver in the closed position;

a second cover having a closed position and an open position, wherein the second cover seals an interior of the second receiver in the closed position;

wherein relative movement of the first receiver toward the second receiver automatically moves the first and second covers from the closed positions to the open positions via a kinematic linkage that begins at a pre-defined distance between the first and second receiver;

a U-shaped cover disposed over the first and second receivers and configured to shield the first and second receivers when the first and second covers are moved away from the closed position and the second receiver is not received in the first receiver.

11. The system of claim 10, further comprising a first housing and a second housing, wherein the first receiver is disposed at least partially within the first housing and the second receiver is disposed at least partially within the second housing.

12. A method for connecting a first contact with a second contact, the method comprising the steps of:

translating a first contact in the form of a plug and a second contact in the form of a socket from a disconnected position relatively axially toward each other into a connected position, wherein the plug is fixed within a first receiver and the socket is fixed within a second receiver and the first receiver and the second receiver axially overlap in the connected position;

in response to translating the plug and socket relatively toward each other, moving a first cover away from a sealed closed position on the first receiver toward an open position and a moving a second cover away from a sealed closed position on the second receiver toward an open position;

in response to translating the plug and socket relatively away from each other, disposing a U-shaped cover over the first and second receivers to shield the first receiver and second receivers when the first and second covers are moved away from the sealed closed position and the second receiver is not received in the first receiver; and wherein the first cover and the second cover are kinematically linked in response to moving the first and second receivers toward each other at a predefined distance between the first and second receivers, such that relative movement between the first and second receivers causes the automatic translation of the first and second covers.

13. The method of claim 12, wherein the first receiver is fixed to a first housing, and the second receiver is fixed to a second housing, and the first and second covers seal the first and second housings, respectively, when the first and second covers are in the closed position.

14. The method of claim 12, wherein the first receiver and the first contact define an annular space therebetween, and the second receiver is received in the first receiver when the first and second covers are open, wherein an outer end of the first receiver seals against an inner portion of the second receiver when the second receiver is received in the annular space.

15. A system for connecting a first contact with a second contact, the system comprising:

a first contact fixed within a cavity of a first receiver;

a second contact fixed within a cavity of a second receiver, wherein the second contact is sized and arranged to mate with the first contact, wherein the first receiver is sized and arranged to mate with the second receiver;

a first cover associated with the first receiver and having a closed position and an open position;

a second cover associated with the second receiver and having a closed position and an open position;

a U-shaped cover disposed over the first and second receivers and configured to shield the first receiver and second receivers when the first and second covers are moved away from the closed position and the second receiver is not received in the first receiver;

wherein relative movement of the first receiver toward the second receiver automatically moves the first and second covers from the closed positions to the open positions via a kinematic linkage that begins at a pre-defined distance between the first and second receiver.

16. The system of claim 15, wherein the second contact and the second receiver are radially adjacent, and the second contact defines a radially interior space, wherein the second contact receives the first contact within the radially interior space, and the first receiver is disposed radially around the second receiver in a connected state.

17. The system of claim 15, wherein the first and second covers seal the cavities of the first and the second receivers, respectively, when the first and second covers are in the closed position.

18. The system of claim 15, wherein the first receiver and the second receiver have a cylindrical shape, the first receiver defines an annular space between the first contact the first receiver, and the second receiver is received in the annular space when the first and second contacts are in a connected state.

19. The system of claim 18, wherein, in the connected state, the first contact is radially within the second contact, the second contact 1 s radially within the second receiver, and the second receiver is radially within the first receiver.

* * * * *